United States Patent [19]

Frates et al.

[11] Patent Number: 4,579,255

[45] Date of Patent: Apr. 1, 1986

[54] LIQUID DISPENSING DEVICE

[75] Inventors: Paul S. Frates, Brunswick, Ohio; Charles H. Scholl, Duluth, Ga.

[73] Assignee: Nordson Corporation, Amherst, Ohio

[21] Appl. No.: 148,276

[22] Filed: May 9, 1980

[51] Int. Cl.[4] ..... B67D 5/06

[52] U.S. Cl. ..... 222/149; 222/518; 222/559; 239/583

[58] Field of Search ..... 222/380, 149; 239/533.9, 533.11, 583, 584; 251/122, 210, DIG. 4, 319; 251/359

[56] References Cited

U.S. PATENT DOCUMENTS

| | | | |
|---|---|---|---|
| 427,152 | 5/1890 | Buttz | 251/210 X |
| 1,901,979 | 3/1933 | Meusy | 251/DIG. 4 |
| 1,962,520 | 6/1934 | O'Malley | 251/359 |
| 3,146,949 | 9/1964 | Reiners | 239/584 X |
| 3,923,252 | 12/1975 | Warning, Sr. et al. | 239/411 |

FOREIGN PATENT DOCUMENTS

| | | | |
|---|---|---|---|
| 2255542 | 5/1974 | Fed. Rep. of Germany | 251/210 |
| 2250905 | 5/1974 | Fed. Rep. of Germany | 251/210 |
| 558928 | 1/1944 | United Kingdom | 239/533.9 |

*Primary Examiner*—Charles A. Marmor

*Attorney, Agent, or Firm*—Wood, Herron & Evans

[57] ABSTRACT

A liquid dispensing device is disclosed in which there is a movable needle operable to open and close a valve seat located within a nozzle of the dispensing device. The needle valve is guided by longitudinal bushing surfaces contained within the nozzle bore. The nozzle has very nearly zero volumetric capacity internally of the nozzle within which liquid may collect between the closed valve seat and the outlet orifice of the nozzle. This "zero capacity" nozzle contains two needle valve engageable seating surfaces, the first of which is operable to close off flow through the nozzle from the dispensing device, and the second of which subsequently closes the nozzle orifice.

9 Claims, 3 Drawing Figures

LIQUID DISPENSING DEVICE

This invention relates to liquid dispensing devices and particularly to devices adapted for dispensing relatively viscous sticky substances such as adhesives, hot melts, sealing compounds, etc.

There are many applications for dispensers in which it is desirable or necessary to sharply cut off the flow of liquid from the nozzle of the device without any drooling, dripping, or stringing of the liquid from the nozzle after closing of the nozzle. To that end there has been a long standing need for a dispensing device which would sharply cut off the flow of liquid from the nozzle when the valve of the nozzle is closed. One such attempt at such sharp cut off of flow is disclosed in U.S. Pat. No. 3,923,252. According to the disclosure patent, sharp cut off may be obtained by maintaining the conically shaped needle valve of the device centered within a frustoconical seat of that device. To that end centering bushings are located within the device through which the needle valve must pass.

Another patent which recognizes the desirability of minimizing dripping or stringing from a nozzle orifice as a desirable end is U.S. Pat. No. 3,841,567. According to the disclosure of this patent, dripping or stringing of viscous liquid from the nozzle orifice after cut off of flow may be minimized by maintaining a minimum volume cavity between the cut off valve and the nozzle orifice of the device.

We have discovered, and one aspect of this invention is predicated upon, the discovery that even sharper cut off of flow from a nozzle of a dispensing device may be achieved by eliminating any cavity at all between the cut off valve and the nozzle orifice. To that end, this invention provides a dispensing device in which there is "zero cavity" or zero volume capacity between the cut off valve and the nozzle orifice. This zero cavity device utilizes a needle valve having a conical tip located within the nozzle of the device and seatable upon a frustoconical seat of the valve which terminates at the nozzle orifice. Immediately upstream of this frustoconical valve seat is a cylindrical section of a valve seat engageable by a cylindrical section of needle valve such that the cylindrical seat of the valve first shuts off flow through the nozzle prior to seating of the conical section of the needle valve upon the frustoconical seat. Thus, when the valve is completely closed there is no volume of liquid contained within the nozzle available to drip or drool from the nozzle orifice.

We have further found that improved seating of the needle valve on the valve seat with a consequent reduction of dripping or drooling from the nozzle may be achieved by providing a needle valve guide surface within the nozzle immediately adjacent the nozzle valve seat. To that end, the nozzle of this invention includes longitudinally extending valve guide surfaces internally of the nozzle. These guide surfaces are defined between longitudinal flow passages which extend through the nozzle at circumferentially spaced locations in the bore of the nozzle.

The primary advantage of this invention is that it provides very sharp cut off of liquid flow from the nozzle whenever the valve of the dispensing device is closed. Consequently, there is no dripping of liquid from the device after valve closing. If the device is used to dispense very viscous substances such as adhesive or sealing compounds, this unique nozzle and needle valve structure materially reduces stringing of the viscous substance between the nozzle orifice and the substrate on which the viscous substance is deposited.

These and other objects and advantages of this invention will be more readily apparent from the following description of the drawings in which.

Figure 1:
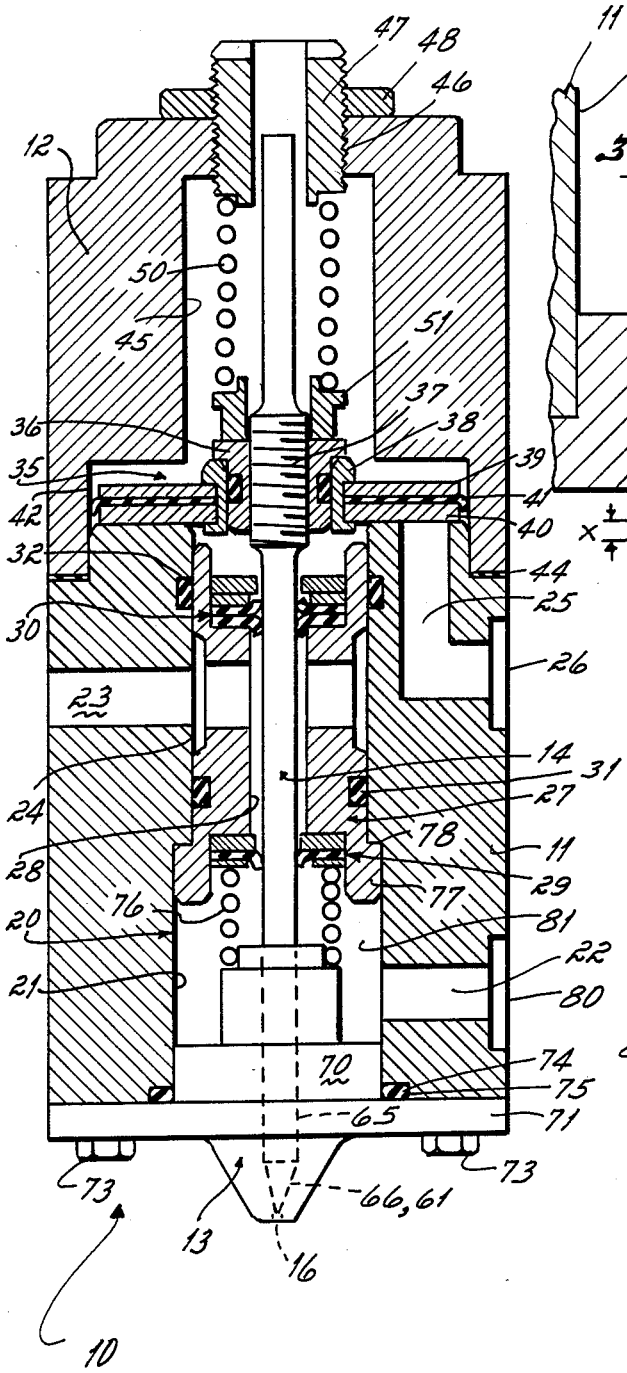
FIG. 1 is a cross sectional view of a dispensing device incorporating the invention of this application.
Figure 2:
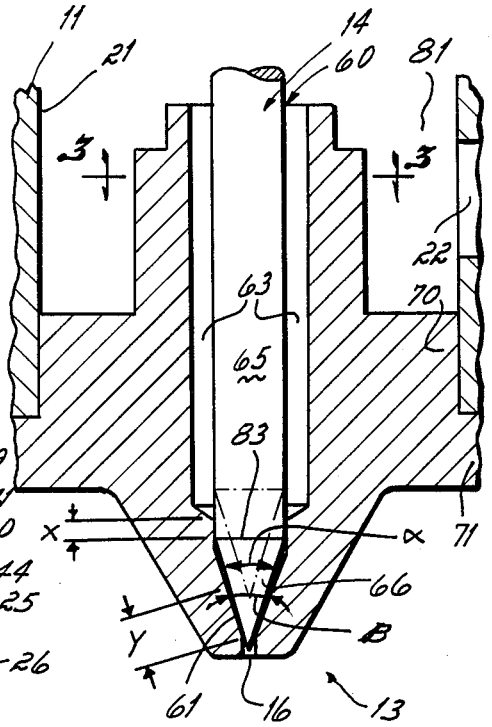
FIG. 2 is an enlarged cross sectional view of the nozzle and nozzle orifice of the dispensing device illustrated in FIG. 1.

Referring to FIGS. 1 and 2, the invention of this application is illustrated as being embodied in a dispensing gun 10. This gun 10 includes a generally cylindrical body 11, an end cap 12, and a nozzle 13. The end cap 12, body 11, and nozzle 13 all have a longitudinal bore extending therethrough within which there is located an axially movable needle valve 14 for controlling flow of liquid from the orifice 16 of the nozzle 13.

The valve body 11 contains a stepped axial bore 20, the larger diameter section 21 of which is located at the forward end of the body. This larger diameter section 21 is intersected by a transverse passage 22 through which liquid is supplied to the gun. Additionally, a vent port 23 intersects the smaller diameter section 24 of the bore 20. There is also an air inlet passage 25 which connects the rear end of the valve body with an inlet air port 26.

A bushing 27 is located within the bore 20 of the body 11. This bushing supports seal assemblies 29 and 30 within a bore 28 which extends longitudinally through the bushing.

To prevent fluid flow around the bushing 27, there is an annular groove in the surface of the bushing within which there is an O-ring seal 31. Additionally, there is an O-ring seal 32 contained within an annular channel formed in the valve body 11.

There is a piston assembly 35 mounted upon the needle valve 14 for controlling movement of the needle valve 14. This piston assembly comprises a nut 36 threaded onto a threaded section 37 of the needle valve and a piston retainer ring 38 sealingly secured onto the periphery of the nut 36. This retainer ring carries a pair of piston rings 39, 40 between which there is sandwiched a resilient gasket 41. The outer edge of this gasket 41 contacts the interior surface of a cylinder 42 formed on the interior of the end cap so as to form a pneumatic seal between the lower side of the piston and the surface of the cylinder 42.

The end cap 12 is bolted onto the upper end of the body 11 by bolts (not shown). Preferably, a resilient gasket seal 44 is located between the contacting surfaces of the end cap and the body.

Communicating with the cylinder 42 formed in the end cap 12, there is a stepped axial bore 45 which extends through the end cap. The upper smaller diameter section 46 of this stepped bore is threaded and receives an adjustment stud 47. A lock nut 48 secures the stud 47 in a position of axial adjustment.

Between the bottom surface of the stud 47 and the top of the piston assembly 35, there is a compression spring 50. The upper end of this compression spring 50 contacts the bottom surface of the stud 47 and the lower end of the spring 50 contacts the top surface of a spring retainer 51. This spring retainer is supported upon the top surface of the piston assembly nut 36. By adjusting the axial position of the stud 47 within the bore 46, the closing force for retaining the needle valve closed may be adjusted or varied.

The dispensing device heretofore described except for the configuration of the needle valve 14 and the nozzle 13, is conventional and per se, forms no part of the invention of this application. Otherwise expressed, the invention of this application resides in the construction of the needle valve 14 and the nozzle 13.

Figure 3:
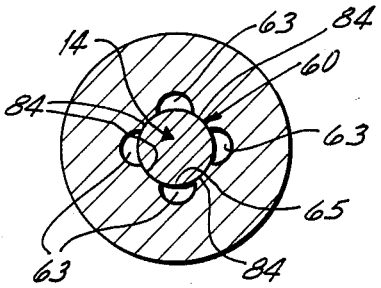
FIG. 3 is a cross sectional view taken on line 3—3 of FIG. 2.

With particular reference to FIGS. 2 and 3, it will be seen that the nozzle 13 contains a generally cylindrical axial bore 60 which extends forwardly from the rear of the nozzle until it intersects a frustoconical valve seat 61 at the forward end of the nozzle. This frustoconical valve seat 61 in turn communicates with a small cylindrical nozzle orifice 16 through which liquid exits from the nozzle.

At its forward end the needle valve 14 has a cylindrical section 65 slideably received within the bore 60 of the nozzle 13. This sliding fit requires that the bore 60 be slightly larger than the cylindrical section 65 of the nozzle, but that there be no more than approximately 0.002 inch clearance between the bore and the needle valve. Preferably, the clearance is approximately 0.001 inch.

Located within the bore 60 and equidistantly spaced therearound, there are four longitudinal grooves or channels 63 which extend for almost the full length of the bore 60. These channels 63 terminate approximately 1/16 inch short of the bottom of the bore so that there is a short cylindrical section of bore 60 which is without any channels formed thereon.

At its forward end the needle valve 14 terminates in a conically shaped valve section 66 engageable with the frustoconical shaped valve seat 61 in the nozzle 13. The conically shaped end section of the nozzle defines an included angle $\alpha$ of approxomately 36° while the valve seat 61 defines an included angle of B of approximately 40°. Consequently, there is some slight clearance between the conically shaped section of the needle valve 65 and the valve seat 61 at the rearward end of the valve seat.

The nozzle 13 has a cylindrical section 70 which is tightly fitted within the large diameter section 21 of cylindrical bore 20 in the body 11. At its forward end the nozzle terminates in a flange 71 which is bolted to the forward end of the body 11 by conventional threaded connectors 73. Preferably, there is an O-ring seal 74 contained within a channel 75 formed in the forward end of the dispenser body 11. This seal 74 prevents any leakage of liquid between the nozzle 13 and the body 11.

To prevent any movement of the bushing 27 within the bore 20, there is a spring 76 located between the rearward end of the nozzle 13 and the forward end of the bushing seal assembly 29. This spring 76 biases the bushing rearwardly and maintains a flange 77 of the bushing engaged with a shoulder 78 formed in the bore 20.

In operation, liquid under pressure is supplied to the liquid inlet port 80 of the device. This port communicates via passage 22 with the bore 21 of the body 10 such that liquid supplied to the port 80 flows into a liquid storage chamber 81 contained within the device. This chamber 81 is in turn open to the longitudinal passages 63 within the nozzle 13.

Whenever the device is to be actuated so as to permit liquid to flow from the storage chamber 81 through the passages 63 and past the valve seat 61 to the orifice 16, high pressure air is supplied to the port 26. This high pressure air overcomes the bias of the spring 50 and causes the piston assembly 35 to move upwardly, carrying with it needle valve 14. This upward movement of the needle valve results in the lifting of the conical section 66 of the valve off of the seat 61 and, when the cylindrical section 65 of the needle valve moves rearwardly past the forwardmost end of the passages 63, results in flow of liquid from the storage chamber 81 through the passages 63 via the valve seat 61 to the orifice 16. This flow continues so long as the air pressure is maintained to the port 26. When that air pressure is relieved, as for example by actuation of a controlling pneumatic valve (not shown) the spring 50 effects closing movement of the valve. This closing movement is sequential in two stages. Firstly, in the process of closing, the forwardmost end 83 of the cylindrical section 65 of the needle valve, passes the forwardmost end of the passages 63 and passes through a first sealing zone indicated by the letter X. As soon as this edge 83 of the cylindrical section passes the forwardmost portion of the passages 63, the flow of liquid from the storage chamber 81 contained internally of the device is cut off to the nozzle orifice 16. Thereafter, as the needle valve continues to travel forwardly, it forces any liquid contained between the conical section 66 of the needle and the frustoconical valve seat 61 forwardly and out of the nozzle orifice 16 until the second sealing stage or zone Y closes and terminates all liquid flow from the orifice 16. This second sealing zone Y is defined by the contacting surfaces of the forwardmost end portion of the conical needle valve section 66 and the forwardmost portion of the frustoconical valve seat 61. Any liquid remaining entrapped in the nozzle between the two zones is miniscule in volume and is not under pressure so that there is no tendency for that remaining liquid to leak and form a droplet or drool from the nozzle orifice 62. Because there is, as a practical matter, no liquid located between the valve seat and the orifice 16, this two stage needle valve and nozzle closing is often referred to as a "zero cavity" nozzle.

The important advantage of this invention resides in the fact that there is no cavity contained in the nozzle between the valve seat and the valve orifice within which liquid is stored. Consequently, there is no liquid available to drip or drool from the nozzle orifice. Leakage of liquid from the nozzle is thereby minimized and flow of liquid from the nozzle is sharply cut off whenever the valve is cycled, which may be at several cycles per second.

Another advantage of this invention resides in the fact that the lands 84 defined in the bore 60 between the liquid passages 63 through the nozzle, provide needle valve guide surfaces in close proximity to the nozzle valve seat. These guide surfaces maintain the needle valve concentric to the valve seat with the result that sharp cut off of flow from the valve is enhanced.

While we have described only a single preferred embodiment of our invention, persons skilled in this art will appreciate changes and modifications which may be made without departing from the spirit of our invention. Therefore, we do not intend to be limited except by the scope of the following appended claims

We claim:

1. A liquid dispensing device having a valve contained therein, said apparatus comprising a nozzle having an axial bore therein, said bore having a frustoconical section and a generally cylindrical section contiguous to said frusto-concial section, said frustoconical section terminating at a nozzle outlet orifice, said frustoconical section defining a valve seat within said nozzle, axially movable needle valve having a conical section on the distal end thereof, said conical section being contiguous to a cylindrical section, said cylindrical section of said needle valve being engageable with said cylindrical section of said bore to close a first zone of said valve, and a portion of said conical section of said needle valve being engageable with said frustoconical valve seat to close a second sealing zone of said valve subsequent to the closing of said first zone, said portion of said conical section of said needle valve which is engageable with said valve seat comprising less than all of said conical section and comprising that portion which is located adjacent the tip of the conical section.

2. The liquid dispensing apparatus of claim 1 wherein said nozzle has a plurality of spaced longitudinally extending needle valve guide surfaces located in close proximity to said cylindrical section of said nozzle bore.

3. The liquid dispensing apparatus of claim 2 wherein said nozzle guide surfaces comprises a plurality of longitudinally extending lands separated by grooves formed on the interior of said nozzle, said grooves extending from one end of said nozzle to a terminus adjacent to but spaced from said frustoconical section of said nozzle bore.

4. The liquid dispensing device of claim 2 wherein said cylindrical section of said nozzle bore extends from said terminus of said grooves to said frustoconical section of said nozzle bore.

5. A liquid dispensing device comprising a body having an axial bore therein, a liquid storage chamber defined at least in part by said bore, a nozzle having an axial bore therein, said bore of said nozzle being in fluid communication with said bore of said body, said nozzle bore having a frustoconical section and a cylindrical section contiguous to said frustoconical section, said frustoconical section terminating at a nozzle outlet orifice, said frustoconical section defining a valve seat within said nozzle, an axially movable needle valve having a conical section on the distal end thereof, said conical section being contiguous to a cylindrical section, said cylindrical section of said needle valve being engageable with said cylindrical section of said bore to close a first zone of said valve, said conical section of said needle valve being engageable with said frustoconical valve seat to close a second sealing zone of said valve subsequent to the closing of said first zone, and said nozzle having a plurality of spaced guide surfaces engageable with said cylindrical section of said needle valve, said guide surfaces comprising a plurality of longitudinally extending lands separated by grooves formed on the interior surface of said nozzle, said grooves extending from one end of said nozzle to a terminus adjacent to but spaced from said frustoconical sections of said nozzle bore, said cylindrical section of said nozzle bore being located between said terminus of said grooves and said frustoconical section of said bore.

6. The liquid dispensing apparatus of claim 5 wherein said device includes pneumatic motor means for effecting axial movement of said needle valve.

7. The device of claim 1 in which said frustoconical section of said nozzle bore is tapered at an angle which is slightly greater than the included angle defined by the conical section of said needle valve so that said conical section of said needle valve contacts said frustoconical section of said nozzle bore adjacent the distal end of said needle valve.

8. A liquid dispensing device having a valve contained therein, said apparatus comprising a nozzle having an axial bore therein, said bore having a frustoconical section and a generally cylindrical section contiguous to said frustoconical section, said frustoconical section terminating at a nozzle outlet orifice, said frustoconical section defining a valve seat within said nozzle, an axially movable needle valve having a conical section on the distal end thereof, said conical section being contiguous to a cylindrical section, said cylindrical section of said needle valve being engageable with said cylindrical section of said bore to close a first zone of said valve, and said conical section of said needle valve being engageable with said frustoconical valve seat to close a second sealing zone of said valve subsequent to the closing of said first zone.

9. A liquid dispensing device comprising a body having a axial bore therein, a liquid storage chamber defined at least in part by said bore, a nozzle having an axial bore therein, said bore of said nozzle being in fluid communication with said bore of said body, said nozzle bore having a frustoconical section and a generally cylindrical section contiguous to said frustoconical section, said frustoconical section terminating at a nozzle outlet orifice, said frustoconical section defining a valve seat within said nozzle, an axially movable needle valve having a conical section on the distal end thereof, said conical section being contiguous to a cylindrical section, said cylindrical section of said needle valve being engageable with said cylindrical section of said bore to close a first zone of said valve, and said conical section of said needle valve being engageable with said frustoconical valve seat to close a second sealing zone of said valve subsequent to the closing of said first zone.

* * * * *